US006164945A

United States Patent [19]

Ishibashi et al.

[11] Patent Number: 6,164,945

[45] Date of Patent: Dec. 26, 2000

[54] VACUUM PUMP ROTOR AND METHOD OF MANUFACTURING THE SAME

[75] Inventors: Yoshimitsu Ishibashi; Katsuaki Usui; Satoshi Arai, all of Tokyo, Japan

[73] Assignee: Ebara Corporation, Tokyo, Japan

[21] Appl. No.: 09/402,805

[22] PCT Filed: Feb. 15, 1999

[86] PCT No.: PCT/JP99/00637

§ 371 Date: Jan. 3, 2000

§ 102(e) Date: Jan. 3, 2000

[87] PCT Pub. No.: WO99/41503

PCT Pub. Date: Aug. 19, 1999

[30] Foreign Application Priority Data

Feb. 13, 1998 [JP] Japan ..... 10-048635

[51] Int. Cl.[7] ..... F10C 1/18

[52] U.S. Cl. ..... 418/206.5; 29/888.023

[58] Field of Search ..... 418/206.5; 29/888.023

[56] References Cited

U.S. PATENT DOCUMENTS

| | | | |
|---|---|---|---|
| 56,614 | 7/1866 | Roots et al. | 418/206.5 |
| 571,770 | 11/1896 | Kurz | 418/206.5 |
| 1,030,083 | 6/1912 | Green | 418/206.5 |
| 2,944,732 | 7/1960 | Lorenz | 418/206.5 |
| 3,302,868 | 2/1967 | Wrede | 418/206.5 |
| 4,938,670 | 7/1990 | Lee | 418/206.5 |
| 4,974,318 | 12/1990 | Heppekausen et al. | 29/888.023 |
| 5,895,210 | 4/1999 | Nakaniwa et al. . | |

FOREIGN PATENT DOCUMENTS

| | | | |
|---|---|---|---|
| 0 546 281 A1 | 6/1993 | European Pat. Off. . | |
| 0 791 750 A1 | 8/1997 | European Pat. Off. . | |
| 415864 | 7/1925 | Germany . | |
| 696509 | 9/1940 | Germany . | |
| 810 419 | 8/1951 | Germany . | |
| 59-131789 | 7/1984 | Japan | 29/888.025 |
| 61-112792 | 5/1986 | Japan | 418/206 |
| 09287581 | 11/1997 | Japan . | |
| 740 050 | 11/1955 | United Kingdom . | |

*Primary Examiner*—Thomas Denion
*Assistant Examiner*—Theresa Trieu
*Attorney, Agent, or Firm*—Armstrong, Westerman, Hattori, McLeland, & Naughton

[57] ABSTRACT

A rotor has an interior free from invasion of water and is resistant to deformation from applied stresses normally encountered during the operation of a vacuum pump. The rotor comprises a rotor shell formed to conform to an outline of lobes and side-plates for covering transverse ends of the rotor shell. A rotation shaft is secured to the side-plates. A hollow section is formed by the rotor shell and the side-plates which is under a vacuum environment.

15 Claims, 4 Drawing Sheets

VACUUM PUMP ROTOR AND METHOD OF MANUFACTURING THE SAME

TECHNICAL FIELD

The present invention relates in general to dry vacuum pumps used in semiconductor device manufacturing processes, for example, and method of making the pump, and relates in particular to a rotor for such a vacuum pump and its method of manufacture.

BACKGROUND ART

A type of dry vacuum pumps comprise a pair of rotors having lobes shaped in an involute or cycloid curvature. These rotors rotate inside a pump casing while closely coupled with the lobes to each other, thereby to pump fluid. Between the lobes, there is a clearance of about 100 $\mu$m so as to avoid using a lubricant.

Many conventional rotors have been made from a solid block of material. There are various way of making such solid rotors, including a method of casting solid lobes and a shaft integrally; or casting solid lobes with an inserted solid shaft; or attaching lobes to a shaft with a key. However, such solid rotors are heavy and are difficult to handle during fabrication and assembly operations. Furthermore, they are loaded with a large inertial moment, and a large torque is required for their dynamic control. For these reasons, construction of a hollow rotor can be considered, where the rotors may be fabricated from sheet or plate materials.

In such pumps, since the hollow rotor is subjected to pressure change while the pump is operated, it is necessary to provide a vent hole in the rotor so that it is not deformed due to the pressure difference between the inside and outside of the rotor. However, in this case, there is a potential danger contaminating rusting of the interior of the rotor due to the effects of humidity in storage or corrosive process gases. Also. There may be a danger to humans from residual gases trapped inside the rotor which may be released during maintenance and repairs of the pump.

DISCLOSURE OF INVENTION

It is an object of the present invention to provide a hollow rotor for use in a dry vacuum pump, and a method for making the hollow rotor. The rotor has a feature that its interior is free from invasion of water and is resistant to deformation from applied stresses normally encountered during the operation of such a vacuum pump.

The object has been achieved in a hollow rotor for use in a vacuum pump comprising: a rotor shell formed to conform to an outline of lobes; side-plates for covering transverse ends of the rotor shell; and a rotation shaft secured to the side-plates, wherein a hollow section formed by the rotor shell and the side-plates is under a vacuum environment.

Accordingly, because the rotor interior is a hermetic hollow structure, the pump is significantly reduced in weight, and achieves prevention of rust formation inside the rotor, and furthermore, by making the hollow section under a vacuum environment, any differential pressure which might be generated during the pumping operation is lessened.

In the rotor, a balancing hole bottoming within a thickness dimension of a side-plate may be provided on a surface location of the side-plate. Accordingly, without destroying the vacuum inside the hollow section, each rotor can be balanced for dynamic stability using the hole provided on the side-plate.

The hollow rotor may be produced according to a method including evacuating a hollow section formed within the rotor shell and the side-plates. The rotor shell and the side plates may be joined by welding.

The evacuation process may be conducted in such a way that at least a final hollow section forming process is conducted in a vacuum and/or high temperature environment thereby to make a vacuum within the hollow rotor.

Or, the hollow section may be evacuated through a vacuum passage provided in the hollow rotor, which is hermetically sealed off after evacuation is completed.

BEST MODE FOR CARRYING OUT THE INVENTION

Figure 1:
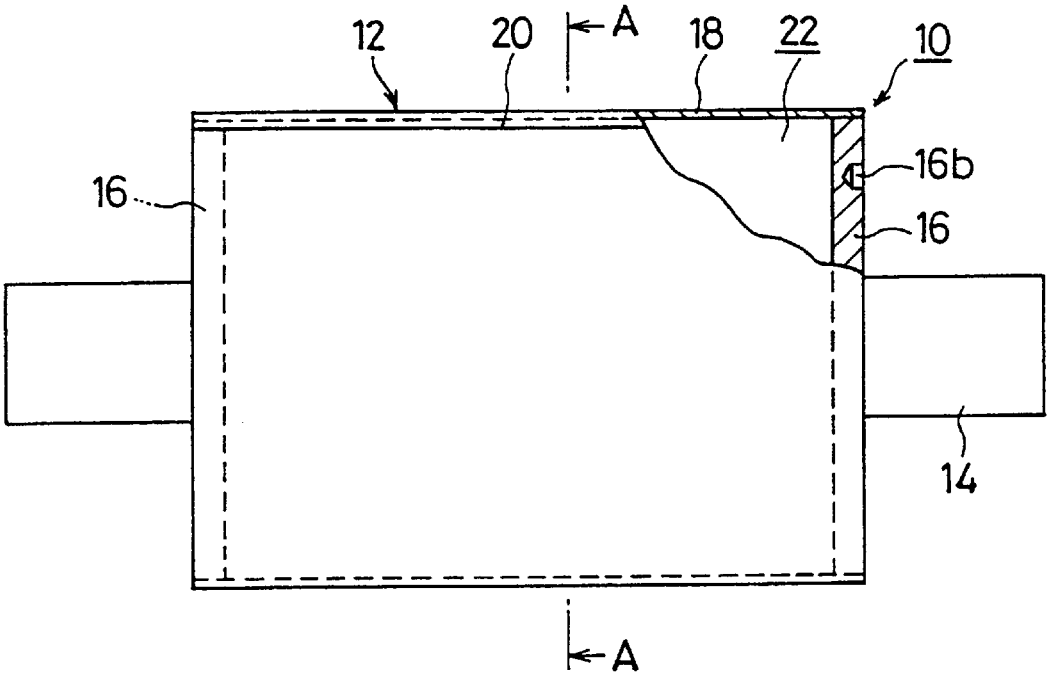
FIG. 1 is a longitudinal view of a partially cutaway vacuum pump of the present invention.
Figure 2:
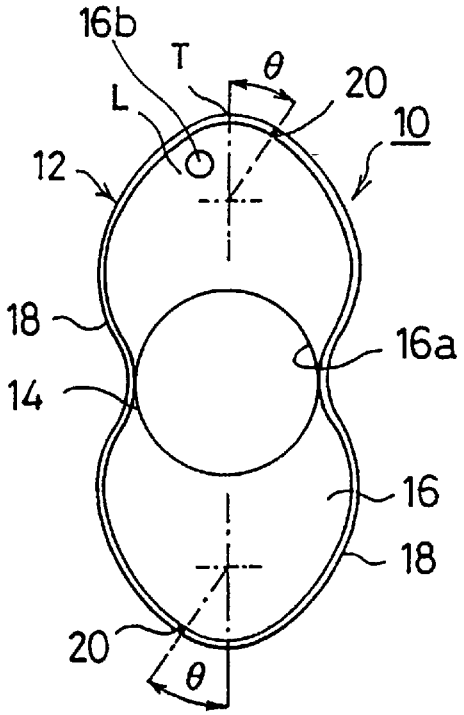
FIG. 2 is a transverse cross sectional view of the embodiment shown in FIG. 1.
Figure 3:
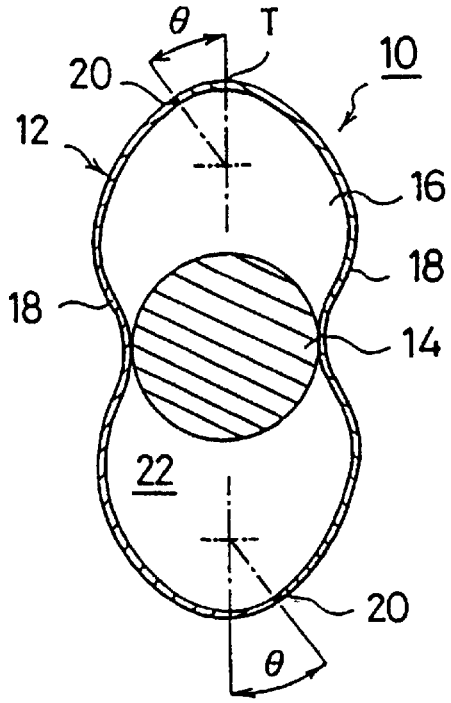
FIG. 3 is a transverse cross sectional view through a plane A—A in FIG. 1.

Preferred embodiments will be explained with reference to the drawings. FIG. 1 to 3 show a two-lobe type rotor 10. This rotor 10 is comprised by: a rotor shell 12 made from one or more sheet members made of a material such as stainless steel which are bent to have a profile of lobes L; and a pair of side-plates 16 having a rotation shaft 14 integrally attached thereto. The profile of the lobe L is an involute or cycloid shape as in the conventional rotors.

A rotor shell 12 is made by butting up two ends of two pieces of shell members 18 of the same shape together and welding the butting surfaces over their width. As shown in FIG. 2, this butt joint section 20 is offset by an angle θ from the apex section T of the lobe L of the rotor 10. The apex section T is the section contacting the inner surface of the casing and the outer surface of the other rotor with a certain amount of clearance, and determines the pumping performance of the vacuum pump. For this reason, the joint section 20 which is susceptible to forming ripples is located away from the apex section T to maintain the dimensional precision of the apex section T thereby improving the pumping performance.

In this example, the rotor shell 12 is made from two shell members 18 which are jointed together by welding. Therefore, there is no need for multiple bending of a large strip thereby improving the fabrication process and precision. Also, the rotor shells 12 are divided into a number of pieces equal to the number of lobes L (two in this example) thereby to make two identically shaped rotor shell member 18. This approach simplifies fabrication processes and inventory management of the shell members 18. In practice, division can be made in any manner, and also the rotor member may be made from one strip.

The side-plate 16 is made of a plate material of slightly thicker material than rotor 12, and is fabricated (punch pressing) so that its outer shape coincides with the shape of the rotor 12. In the center of the side-plate 16, a shaft hole 16*a* is made for inserting a rotation shaft 14 and welding to the plate 16 over its entire circumference. At a suitable location on the surface of the plate 16, there is a balancing hole 16*b* bottoming only within and not penetrating the plate thickness for balance adjusting. The side-plate 16 is coupled to the transverse end section of the rotor shell 12 and is welded to the rotor shell 12 over its entire periphery to form a hermetic hollow section 22 which is in an evacuated state.

An example of method of making the rotor 10 described above will be explained. First, rectangular blank plates made by such method as press punching are prepared, and the blank plates are formed into shell members 18 of a certain shape by bending process. Two pieces of such shell members 18 are butted together by aligning them with 180 degrees phase difference about the shaft center, and the butted section is welded over the entire width, thereby making a rotor shell 12 having two open transverse end sections.

In the meantime, the side-plates 16 are produced cutting strips by means such as press punching to produce side-plates 16 having a shaft hole 16*a* and a suitable external shape to fit inside the rotor shell 12. The shaft 14 is inserted through the hole 16*a*, and is welded to the side-plate 16 at a suitable location over its circumference by such means as arc welding. The side-plate 16, having the welded side-plate 16, is inserted inside the rotor shell 12 and the contact section is joined by such means as a laser welding in a vacuum and/or high temperature over the entire periphery, to make a hollow section 22 of an evacuated interior environment. Welds are dressed by such means as grinding, and balancing holes 16*b* are provided where necessary.

In the above process, it is permissible to weld the shaft 14 after joining a rotor shell 12 with side plates 16. In this case, the hollow section 22 is made into an evacuated environment, by performing welding of the rotation shaft 14 to the side plates 16 in a vacuum and/or high temperature.

Figure 4:
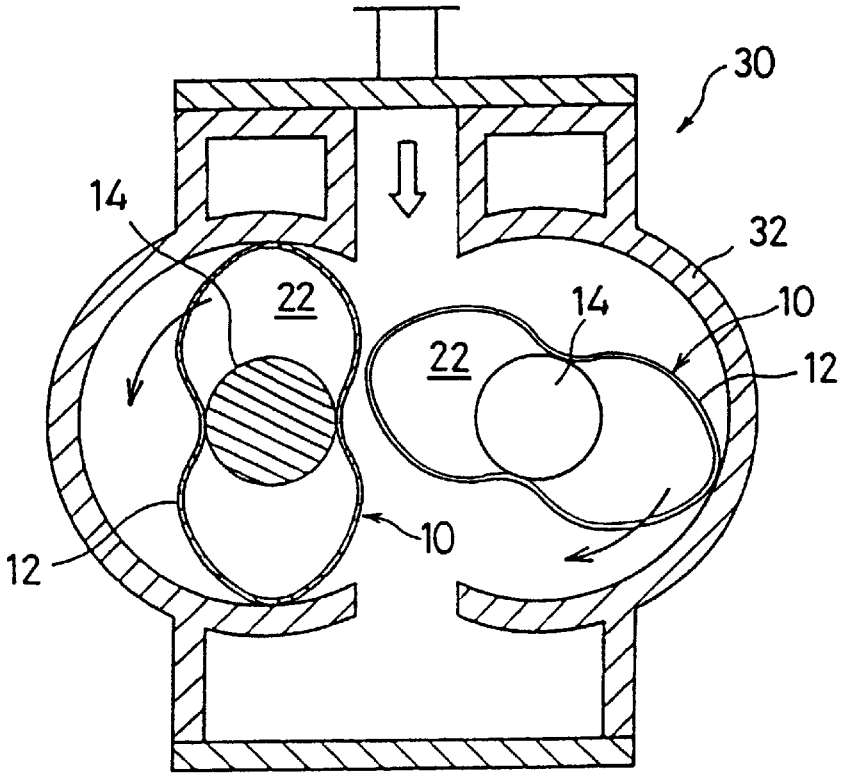
FIG. 4 is a transverse cross sectional end view of an example of the vacuum pump using the rotor shown in FIGS. 1–3.

FIG. 4 is a transverse view of a vacuum pump 30 using rotors 10 made by the method described above. Casing 32 has two parallel rotation shafts 14 which are driven together by linked gears (not shown), and the phase angles of the rotors 10 are suitably shifted with respect to each other. This type of vacuum pump is light weight and has low dynamic momentum because of the hollow rotors 10, and has excellent dynamic response characteristics. Also, because the rotor 10 can be made at low cost by machining process, the pump manufacturing cost is also low.

Further, the hollow section 22 separated by the rotor shell 12 and side plates 16 is completely isolated from the external environment, so that the hollow section 22 does not experience problems such as rusting in the interior surfaces and collecting gases therein. The hollow section 22 is under a vacuum environment so that, when the pressure inside the casing 32 is lowered during the pumping operation, a differential pressure between inside and outside the rotor 10 is small. Therefore, distortion of the rotor 10 is prevented. Also, when the pump is not operated, rotor 10 is exposed to atmospheric pressure, but a differential pressure is at most one atmosphere, so that no large deformation can be expected, and furthermore, the direction of pressure is compression, so that it causes no distortion that leads to contact between the rotors or rotors with pump walls.

FIG. 5 shows another example of method for manufacturing a vacuum pump according to the present invention. In this method, an evacuation assist device 50 is attached to an opening 16*a* of one of the side plates 16. This evacuation assist device 50 is comprised by a pipe 56 having flanges 52, 54 at the respective ends, and an internal movable plug member 58 that can move in the axial direction within the pipe 56. The movable plug member 58 comprises a sealing plug 60 and a guide head 62 connected by a shaft 64. The sealing plug 60 and the shaft 64 are detachably connected by threading connection for example. At the tip end of the internal periphery of the pipe 56, a stopper (a step) 66 is provided to prevent the guide head 62 from falling through.

Figure 5A:
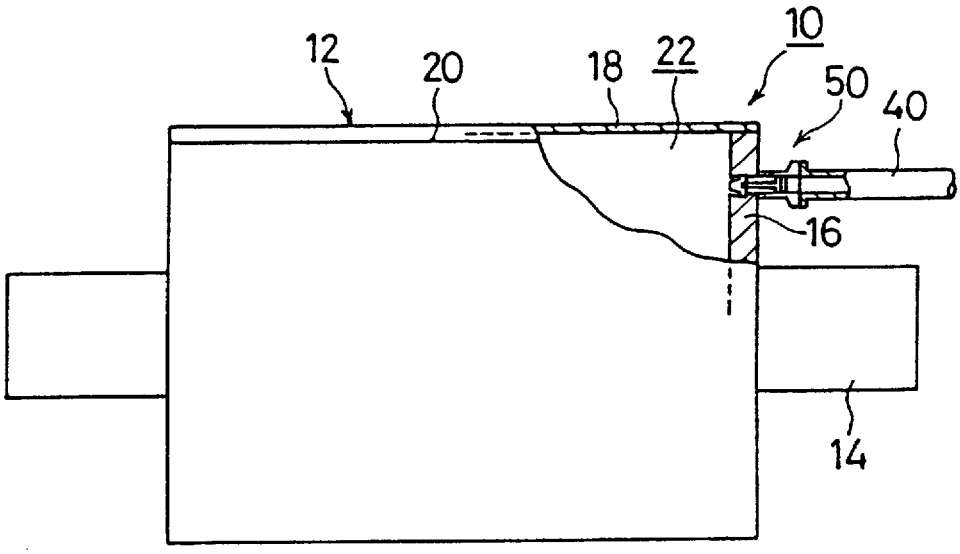
FIG. 5 is a longitudinal partially cutaway view of another method of making the rotor of the present invention.
Figure 5B:
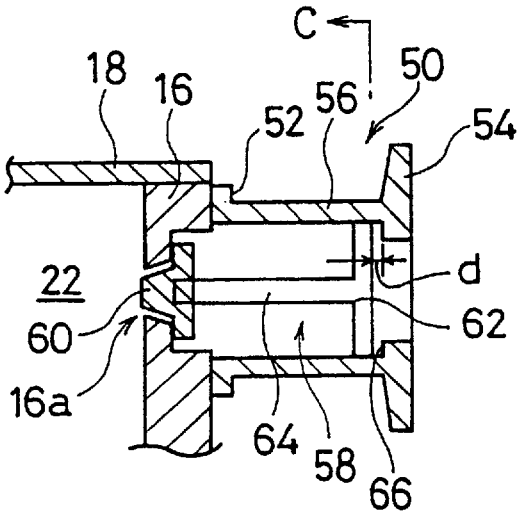
Figure 5C:
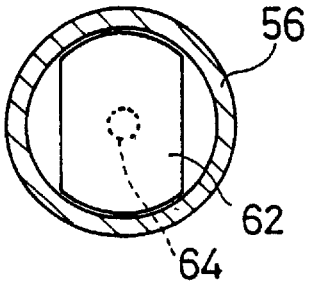

The external periphery of the guide head 62 has arc sections and straight sections, as shown in FIG. 5C, thereby making it possible to evacuate through the spaces formed in the straight portions while permitting the head 62 to slide inside the pipe 56. Sealing plug 60 is made to fit the cross sectional shape of the opening 16*a* of the side plate 16, and in this case, a step section and a tapered section are provided. The length of the shaft 64 is chosen so that, when the pipe 56 is fixed to the side plate 16, the movable plug member 58 can move by a small distance d, as shown in FIG. 5B, in the axial direction.

The evacuation assist device 50 is attached to the side plate 16 through a flange 52, as shown in FIG. 5A, by adhesive or tack welding. The evacuation assist device 50 is also attached to an evacuation pipe 40 through a flange 54 and evacuation is performed by an exhaust pump connected to the evacuation pipe 40. In this case, the movable plug member 58 is moved outward by suction until the guide head 62 touches the stopper 66. This motion creates a space between the sealing plug 60 and the opening 16*a* of the side plate 16, thereby enabling the interior hollow section 22 inside the rotor 10 to be evacuated. When the exhaust pump is stopped, movable plug member 58 is pulled by the vacuum in the hollow section 22 to move inward so that the sealing plug 60 closes the opening 16*a*. To improve hermetic condition, elastic sealing members may be placed in suitable locations between the sealing plug 60 and the opening 16*a*.

The pipe 56 is detached in this condition so that the opening 16*a* can be accessed for attaching the sealing plug 60 to the periphery of the opening 16*a* by means such as welding. The hollow section 22 is thus sealed off. Shaft 64 can be removed any time before or after the welding step. In this method, the degree of vacuum in the hollow section can be confirmed to some extent so long as the sealing plug 60 does not drop off, thereby saving the effort to check the vacuum. By following the steps outlined above, the hollow section 22 inside the rotor 10 can be reliably evacuated to a high degree of vacuum.

Figure 6:
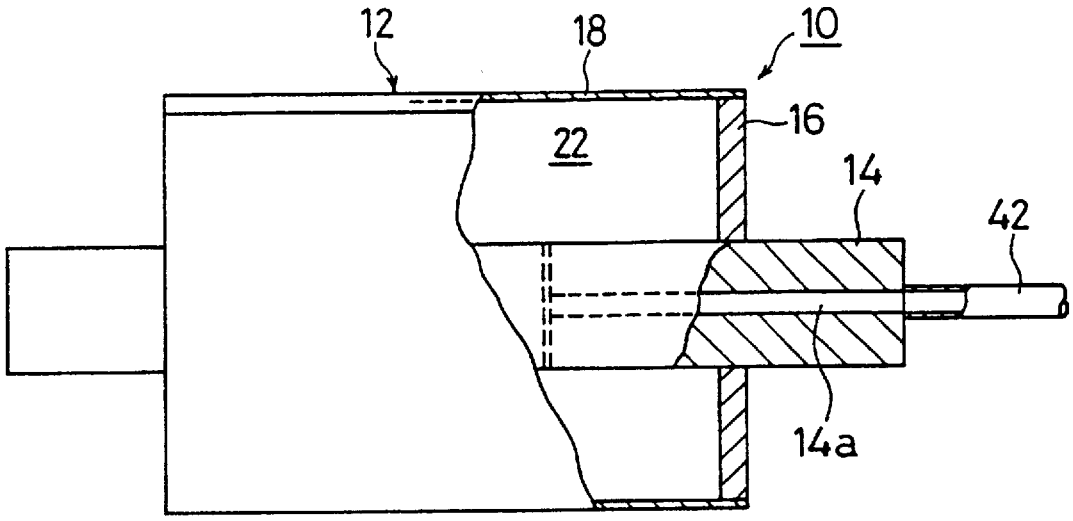
FIG. 6 is a longitudinal partially cutaway view of yet another method of making the rotor of the present invention.

FIG. 6 shows another example of the manufacturing method. In this case, the rotation shaft 14 has a vacuum passage 14*a* which opens to an inner space of the hollow section 22 at the inside end of the shaft 14. After performing weld assembly operations under atmospheric pressure as before, a pipe 42 is coupled to the vacuum passage 14*a* to evacuate the hollow section 22 of the rotor 10. When a suitable degree of vacuum is reached, the opening of the vacuum passage 14*a* is sealed off and pipe 42 is removed, thus to provide a suitable vacuum environment inside the hollow section 22.

INDUSTRIAL APPLICABILITY

The present invention is useful as a rotor for use in dry vacuum pumps used in semiconductor device manufacturing processes.

What is claimed is:

1. A hollow rotor for use in a vacuum pump comprising:

a rotor shell formed to conform to an outline of lobes;

side-plates for covering transverse ends of said rotor shell; and a rotation shaft secured to said side-plates, wherein a hollow section formed by said rotor shell and said side-plates is under a vacuum environment.

2. A hollow rotor according to claim 1, wherein a balancing hole is provided on a surface location of said side-plate, said balancing hole bottoming within a thickness dimension of said side-plate.

3. A hollow rotor according to claim 1, wherein said rotor shell is comprised by at least one sheet-like rotor shell member, said rotor shell member is formed to conform to an outline of lobes through bending process.

4. A hollow rotor according to claim 3, wherein joint edges of said rotor shell member is offset from apex of said lobes.

5. A hollow rotor according to claim 3, wherein said rotor shell is comprised by a number of said rotor shell members corresponding to a number of said lobes.

6. A hollow rotor according to claim 3, wherein edges of said rotor shell member are joined by welding.

7. A hollow rotor according to claim 1, wherein said rotor shell and said side plates are joined by welding.

8. A method for making a hollow rotor, said hollow rotor comprising a rotor shell formed to conform to an outline of lobes; side-plates for covering transverse ends of said rotor shell; and a rotation shaft secured to said side-plates, said method including evacuating a hollow section formed within said rotor shell and said side-plates.

9. A method according to claim 8, wherein said rotor shell and said side plates are joined by welding.

10. A method according to claim 8, wherein at least a final hollow section forming process is conducted in a vacuum and/or high temperature environment thereby to make a vacuum within said hollow rotor.

11. A method according to claim 8, wherein said hollow section is evacuated through a vacuum passage provided in said hollow rotor, said vacuum passage is hermetically sealed off after evacuation is completed.

12. A method according to claim 11, wherein said vacuum passage is provided in said side-plate.

13. A method according to claim 12, wherein said vacuum passage is provided by an evacuation assist device detachably attached to an opening of said side plates, said evacuation assist device comprising an internal movable plug member having a plug portion for closing said opening.

14. A method according to claim 11, wherein said vacuum passage is provided through said rotation shaft.

15. A vacuum pump having a pair of rotors, a pump casing encasing said pair of rotors, and a drive mechanism for synchronously rotating said pair of rotors, said rotors comprising:

a rotor shell formed to conform to an outline of lobes;

side-plates for covering transverse ends of said rotor shell; and a rotation shaft secured to said side-plates, wherein a hollow section formed by said rotor shell and said side-plates is under a vacuum environment.

* * * * *